US012084971B1

(12) United States Patent
Lei et al.

(10) Patent No.: US 12,084,971 B1
(45) Date of Patent: Sep. 10, 2024

(54) UNDERCUTTING-COVERED EXCAVATION SEMI-REVERSE CONSTRUCTION METHOD OF CROSS-TRANSFER SUBWAY STATION

(71) Applicant: Beijing Urban Construction Design & Development Group Co., Limited, Beijing (CN)

(72) Inventors: Gang Lei, Beijing (CN); Zhihui Yang, Beijing (CN); Fucai Hua, Beijing (CN); Chao Xie, Beijing (CN); Jianye Zhu, Beijing (CN); Chao Li, Beijing (CN); Ningning Li, Beijing (CN); Tingting Zhou, Beijing (CN)

(73) Assignee: Beijing Urban Construction Design & Development Group Co., Limited, Beijing (CN)

( * ) Notice: Subject to any disclaimer, the term of this patent is extended or adjusted under 35 U.S.C. 154(b) by 0 days.

(21) Appl. No.: 18/673,287

(22) Filed: May 23, 2024

(30) Foreign Application Priority Data

Nov. 6, 2023 (CN) ..... 202311460950.8

(51) Int. Cl.
*E21D 11/00* (2006.01)
*B61B 1/00* (2006.01)
*E21D 11/10* (2006.01)

(52) U.S. Cl.
CPC ..... *E21D 11/107* (2013.01); *B61B 1/00* (2013.01)

(58) Field of Classification Search
CPC ..... E21D 11/04; E21D 11/12; E21D 11/107; E21D 13/00
See application file for complete search history.

(56) References Cited

U.S. PATENT DOCUMENTS 3,616,650 A * 11/1971 Eber et al. ..... E21D 9/1053 405/146
3,916,630 A * 11/1975 Arsuaga ..... E21D 9/0692 405/146
4,603,910 A 8/1986 Laneus
4,929,123 A * 5/1990 Lunardi ..... E21D 9/005 405/138
5,104,259 A 4/1992 Svensson
5,118,220 A 6/1992 Furumi et al.
5,199,817 A * 4/1993 Wagner ..... E21D 13/00 405/150.2
10,280,749 B2 * 5/2019 Chen ..... E21D 11/105
2020/0263543 A1 * 8/2020 Mulvoy ..... E21D 11/107

FOREIGN PATENT DOCUMENTS

CN 106337686 A * 1/2017

* cited by examiner

*Primary Examiner* — Benjamin F Fiorello

(57) ABSTRACT

A section of a node of the station is a section with an arch roof and a straight wall of three underground floors, a first underground floor is a station hall floor 1, and a second underground floor is a platform floor 2 of a subway line A and a third underground floor is a platform floor 3 of a subway line B; and directions of the subway line A and the subway line B are orthogonal. Second lining structures of the first and second underground floors are firstly constructed, and after a shield tunneling machine is pushed through the station, the structure of the third underground floor is constructed by a reverse construction method. Thus, the present disclosure is conducive to improving the efficiency of overall construction, guaranteeing timely tunnel construction completion of two lines and hence timely track construction completion and electricity wiring completion.

9 Claims, 19 Drawing Sheets

UNDERCUTTING-COVERED EXCAVATION SEMI-REVERSE CONSTRUCTION METHOD OF CROSS-TRANSFER SUBWAY STATION

CROSS-REFERENCE TO RELATED APPLICATIONS

This application claims priority to Chinese Patent Application No. 202311460950.8 with a filing date of Nov. 6, 2023. The content of the aforementioned application, including any intervening amendments thereto, is incorporated herein by reference.

TECHNICAL FIELD

The present disclosure relates to the technical field of underground engineering constructions, and in particular, to an undercutting-covered excavation semi-reverse construction method of a cross-transfer subway station.

BACKGROUND

At present, the construction of an urban rail transit system network has become the focus of traffic constructions for many big cities. The networking development of urban rail transit construction has a basic feature of forming an increasing number of transfer nodes at line network intersections. A transfer hub is generally established at such a transfer node with a huge flow of people, allowing passengers to transfer from one line to another line rapidly. Node transfer is one of the most common transfer manners, which generally refers to a transfer manner in which two lines intersect, as compared with parallel transfer. At a position where two lines intersect, an overlapping area of tunnels of the two lines is structured as a whole, which is known as the transfer node. Generally speaking, the section of the transfer node is a three underground-floor large section, where a first underground floor is a station hall, and second and third underground floors are stations of two lines. The construction of a station may easily have an impact on a construction period by an interzone mechanical method. The impact on the construction period of a transfer node is especially serious because the interzone construction periods of two lines need to be taken into account. The worst case is that a shield tunneling machine for a line has been placed at the site of the station of the second underground floor and the transfer node needs to have the condition for pushing the shield tunneling machine through a medium slab as early as possible. In this case, the excavation of the complete section needs to be carried out by a traditional construction method and the shield tunneling machine can be pushed through the station after consequent operation of the second lining structure of the station is carried out from bottom to top (at least the medium slab should be completed and the design strength should be reached). In this case, not only may a high side wall of a three-floor section be excavated, but also the construction period of the station is long, thereby delaying passing of the shield tunneling machine through the station and affecting the penetration of the interzone node.

To this end, the designers of the present disclosure design an undercutting-covered excavation semi-reverse construction method of a cross-transfer subway station by concentrating on researches and by combining the experience and outcomes in the related industry for many years, so as to overcome the above defects.

SUMMARY OF PRESENT INVENTION

An objective of the present disclosure is to provide an undercutting-covered excavation semi-reverse construction method of a cross-transfer subway station that can overcome the defects of the prior art, improve the efficiency of overall construction, better shorten the construction period of a whole line, and reduce construction risks.

To achieve the above objective, the present disclosure provides an undercutting-covered excavation semi-reverse construction method of a cross-transfer subway station, where a section of a node of the cross-transfer subway station covers three underground floors, where a first underground floor is a station hall floor, and a second underground floor is a platform floor of a subway line A and a third underground floor is a platform floor of a subway line B; directions of the subway line A and the subway line B are orthogonal; construction is carried out by an arch covering method at the station hall floor and the platform floor of the subway line A; and after a shield tunneling machine for interzone construction of the subway line A is pushed through the station, construction of the platform floor of the subway line B is carried out by covered excavation using a reverse construction method under the section constructed by the arch covering method; the undercutting-covered excavation semi-reverse construction method including the following steps:

- step 1: stepwise excavating a left pilot tunnel of an arch; after the completion of excavation, initially spraying 40 mm thick concrete to close surrounding rock, applying anchor bolts, arranging a grid arch frame, erecting a temporary steel arch frame for the left pilot tunnel of the arch, and spraying concrete again to a thickness of 350 mm;
- step 2: stepwise excavating a right pilot tunnel of the arch; after the completion of excavation, initially spraying 40 mm thick concrete immediately to close surrounding rock, applying anchor bolts, arranging a grid arch frame, erecting a temporary steel arch frame, and spraying concrete again to a thickness of 350 mm;
- step 3: excavating remaining surrounding rock of a middle pilot tunnel of the arch of the station and building in a temporary steel arch frame for the middle pilot tunnel of the arch;
- step 4: applying a bottom bedding course, and applying arch foot joists on two sides after the bottom bedding course reaches a strength;
- step 5: removing part of the temporary steel arch frame by means of a spatial effect, laying a waterproofing course, and applying a second lining structure of an arch covering and reserving a side wall construction seam;
- step 6: after the second lining structure of the arch covering reaches a design strength, carrying out step-slope excavation of middle-layer core soil;
- step 7: excavating surrounding rocks on two sides of the middle layer of the station layer by layer from top to bottom; excavating to current layer at each step and driving anchor bolts downwards by 0.5 m, and carrying out next step of excavation after the completion of applying the anchor bolts on two sides and spraying concrete;
- step 8: after excavation to a design elevation, backfilling grouted tunnel wastes to a bottom elevation of a medium slab of the second underground floor, and after a foundation bearing capacity required for pushing the shield tunneling machine is met, carrying out consequent operation of a medium slab structure and second lining structures for side walls of the first and second underground floors from bottom to top;
- step 9: after the second lining structure of the medium slab of the second underground floor reaches a design strength, backfilling a subgrade, laying a track, and pushing the shield tunneling machine for the construction of the subway line A through the station;

step 10: using an interzone tunnel of a left line of the subway line B as a construction passageway, cyclically excavating the platform floor of the subway line B, and timely applying a temporary steel support; after the completion of each round of excavation, gradually removing the support, timely applying a second lining structure of the third underground floor, and after the completion of applying the second lining structure of the third underground floor, carrying out next round of excavation; and step 11: after the completion of the second lining structure of the third underground floor, excavating remaining interzone ports of the subway line B, and applying an internal structure after a shield tunneling machine for the construction of the subway line B is pushed through the station.

In step 1, at least one feet-lock bolt is driven into a position of an anchor foot of the left pilot tunnel of the arch; and in the step 2, at least one feet-lock bolt is driven into a position of an anchor foot of the right pilot tunnel of the arch.

In step 1 and step 2, a footage of each pilot tunnel is greater than or equal to 15 m when the pilot tunnel is excavated.

In step 4, inner ends of the feet-lock bolts 14 driven in the step 1 and step 2 are cast within the arch foot joists, thereby ensuring that the arch foot joists are stable and reliable.

The second lining structure 17 of the arch covering in the step 5 is formed through one step, and L-shaped joints are disposed at joints of the side wall construction seam, respectively.

A slope of the step-slope excavation in the step 6 is not greater than 1:0.5, and a horizontal distance of tops of side slopes on two sides is not less than 3 m.

The grouted tunnel wastes backfilled in the step 8 are uniformly roll-compacted with a compactness of greater than or equal to 93%; during roll-compacting, each layer is 25 cm to 30 cm thick; the second lining structures and permanent concrete columns of the first and second underground floors are cast below the medium slab of the second underground floor by not less than 500 mm; a ratio of reserved joints of reinforcements at a same section is not greater than 50%.

Step 10 includes the following sub-steps:

step 10.1: using the interzone tunnel of the left line of the subway line B as the construction passageway, firstly excavating a track area of the left line of the third underground floor using a step method, carrying out excavation by a cyclical footage, and after the completion of excavation of the footage per round, carrying out bolting and shotcreting in time and erecting the temporary steel support to support a top slab of the third underground floor;

step 10.2: entering into the tunnel from a middle position, and excavating the middle pilot tunnel of the third underground floor; carrying out excavation by a cyclical footage also by the step method, and after the completion of excavation of the footage per round, carrying out bolting and shotcreting in time and erecting the temporary steel support to support the top slab of the third underground floor; meanwhile, gradually applying the second lining structure of the third underground floor for the track area of the left line of the third underground floor;

step 10.3: opening tunnels on two sides to excavate a track area of a right line of the third underground line; carrying out excavation by a cyclical footage, and after the completion of excavation of the footage per round, carrying out bolting and shotcreting in time and erecting the temporary steel support to support the top slab of the third underground floor; completing the second lining structure of the third underground floor for the track area of the left line of the third underground floor, and adjusting the temporary support of the track area of the left line of the third underground floor to be within the range of the second lining structure;

step 10.4: subsequently applying the second lining structures of the middle pilot tunnel and the track area of the right line of the third underground floor, and after the completion of application and closure of the second lining structure of the third underground floor, adjusting the temporary steel support to be within the range of the second lining structure;

step 10.5: excavating remaining rock mass in the middle, carrying out excavation by a cyclical footage also by the step method, and after the completion of excavation of the footage per round, carrying out bolting and shotcreting in time and erecting the temporary steel support to support the top slab of the third underground floor;

step 10.6: completing the remaining second lining structure of the third underground floor, and providing the temporary steel support; and step 10.7: excavating an interzone tunnel of the right line of the subway line B, erecting three grid steel frames, spraying C25 concrete immediately after excavation to close the surrounding rock, erecting the grid arch frame, erecting the temporary steel support, binding a mesh reinforcement, and spraying concrete.

In steps 10.1, 10.2, 10.3, and 10.5, the footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure is taken.

As can be known from the above contents, the undercutting-covered excavation semi-reverse construction method of a cross-transfer subway station of the present disclosure has the following effects:

1. By the method of firstly constructing the second lining structures of the first and second underground floors and carrying out reverse construction of the structure of the third underground floor after pushing the shield tunneling machine through the station, the efficiency of overall construction can be improved, guaranteeing timely tunnel construction completion of two lines and hence timely track construction completion and electricity wiring completion, so that the subway lines can be opened to traffic as early as possible.
2. Compared with a traditional method of carrying out consequent operation of a structure after the completion of excavation of an overall section, the construction period may be shortened by at least three months.
3. Moreover, compared with excavation of the entire three-floor section by using a double-side heading method, this method reduces risks induced by a high side wall. Therefore, this method is a method that can improve the construction efficiency, shorten the construction period of the whole line, and reduce the construction risks to the utmost extent on the basis of guaranteeing safety.

The detailed contents of the present disclosure may be obtained from the following description and the accompanying drawings.

LIST OF REFERENCE NUMERALS

1—station hall floor; 2—platform floor of subway line A; 3—platform floor of subway line B; 6—permanent concrete column; 7—anchor bolt; 11—left pilot tunnel of arch; 12—right pilot tunnel of arch; 13—middle pilot tunnel of arch; 14—feet-lock bolt; 15—temporary steel arch frame; 16—arch foot joist; 17—second lining structure of arch covering; 18—L-shaped joint; 19—medium slab of first underground floor; 21—interzone tunnel of left line of subway line A; 22—interzone tunnel of right line of subway line A; 23—medium slab of second underground floor; 24—second lining structures for side walls of first and second underground floors; 31—grouted tunnel wastes; 32—temporary steel support; 33—interzone tunnel of left line of subway line B; 34—interzone tunnel of right line of subway line B; 35—second lining structure of third underground floor; 36—port ring beam; 37—transfer passageway of third underground floor; 38—partition wall of track area; 3A—track area of left line of third underground floor; 3B—middle pilot tunnel of third underground floor; 3C—track area of right line of third underground floor; and 3D—middle remaining rock mass of third underground floor.

DETAILED DESCRIPTION OF THE EMBODIMENTS

Figure 1:
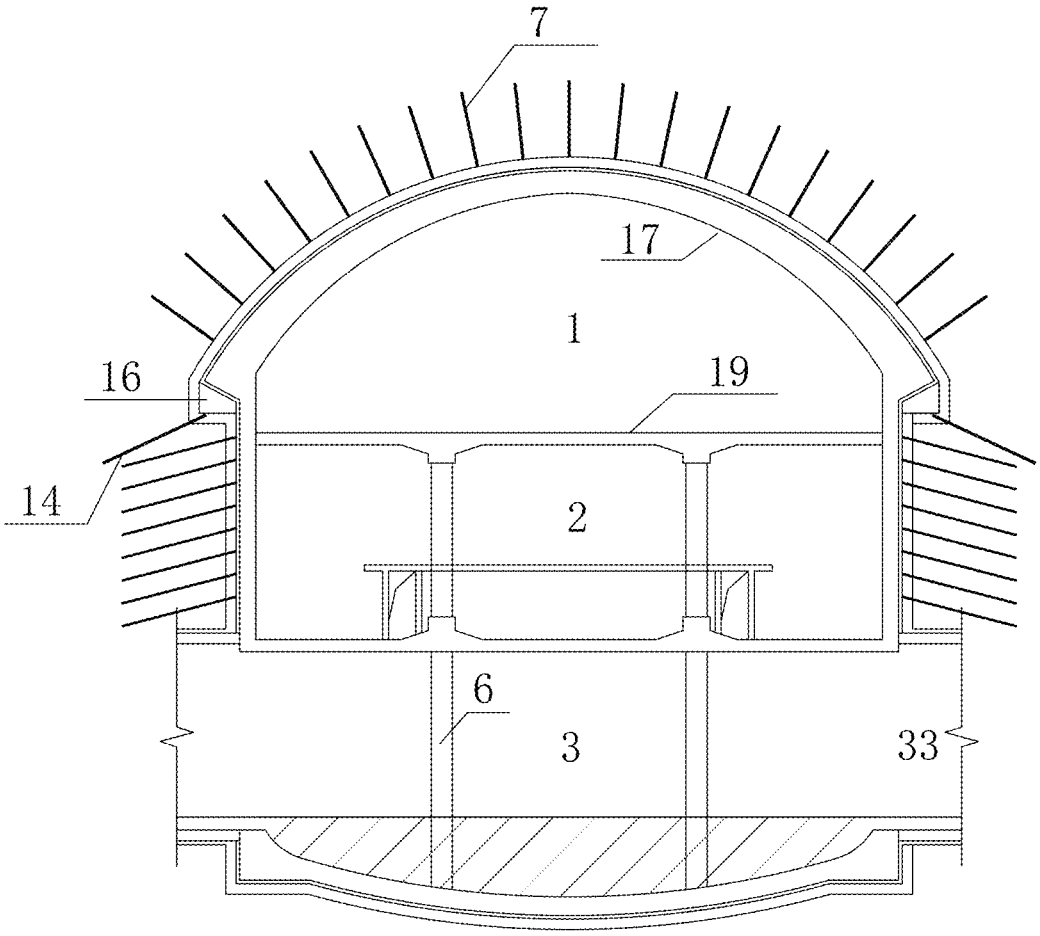
FIG. 1 shows a schematic diagram of a sectional structure of a transfer node of the present disclosure.
Figure 2:
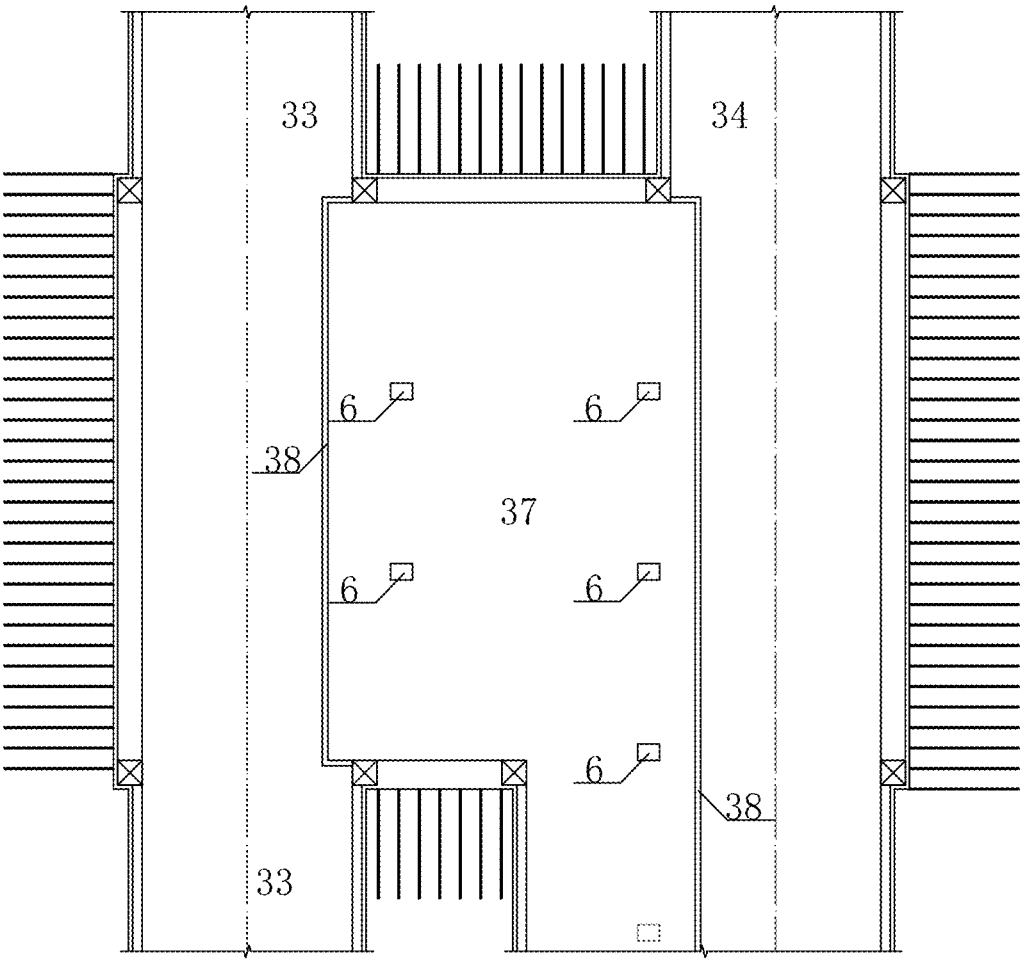
FIG. 2 shows a planar schematic diagram of a third underground floor of a transfer node of the present disclosure.

With reference to FIG. 1 and FIG. 2, FIG. 1 and FIG. 2 show a form of a node of the cross-transfer subway station in an undercutting-covered excavation semi-reverse construction method of a cross-transfer subway station of the present disclosure. A section of the node of the station is a section with an arch roof and a straight wall of three underground floors, where a first underground floor is a station hall floor 1, and a second underground floor is a platform floor 2 of a subway line A and a third underground floor is a platform floor 3 of a subway line B; and directions of the subway line A and the subway line B are orthogonal. The transfer node may be a cross transfer, T-shaped transfer, or L-shaped transfer node. The transfer node will not be limited here as long as the transfer node is in the form described in the present disclosure.

According to the undercutting-covered excavation semi-reverse construction method of a cross-transfer subway station, construction is carried out by an arch covering method at the station hall floor 1 and the platform floor 2 of the subway line A; and after a shield tunneling machine for interzone construction of the subway line A is pushed through the station, construction of the platform floor 3 of the subway line B is carried out by covered excavation using a reverse construction method under the section constructed by the arch covering method. Specifically, the present disclosure may include the following steps.

Figure 3A:
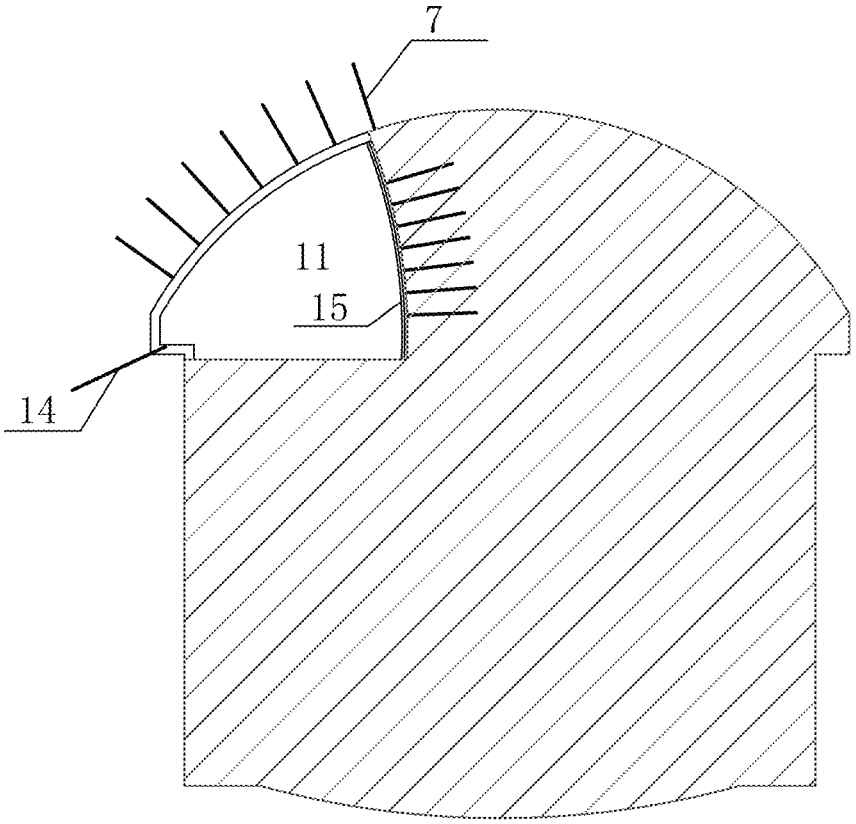
FIG. 3A to FIG. 3I show schematic diagram of a construction order of an undercutting-covered excavation semi-reverse construction method of a cross-transfer subway station at a section of a transfer node according to the present disclosure.

In step 1, with reference to FIG. 3A, a left pilot tunnel 11 of an arch is stepwise excavated; after the completion of excavation, 40 mm thick concrete is initially sprayed immediately to close surrounding rock; anchor bolts 7 are applied at the top of the left pilot tunnel 11 of the arch; a grid arch frame is arranged; a temporary steel arch frame 15 for the left pilot tunnel 11 of the arch is erected, a mesh reinforcement is bound, and concrete is sprayed again to a thickness of 350 mm. To ensure stable preliminary supporting, at least one feet-lock bolt 14 is driven into a position of an anchor foot of the left pilot tunnel 11 of the arch.

Figure 3B:
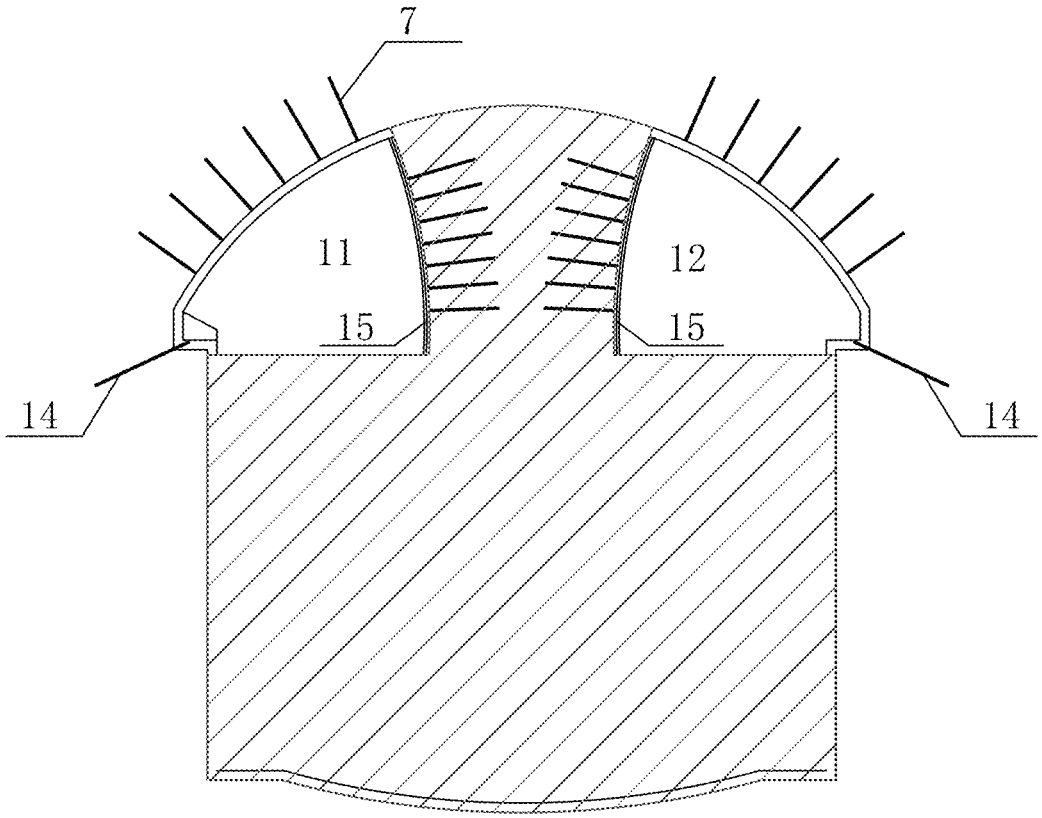

In step 2, with reference to FIG. 3B, a right pilot tunnel 12 of the arch is stepwise excavated; after the completion of excavation, 40 mm thick concrete is initially sprayed immediately to close surrounding rock; anchor bolts 7 are applied to the right pilot tunnel 12 of the arch; a grid arch frame is arranged; a temporary steel arch frame 15 for the right pilot tunnel 12 of the arch is erected, a mesh reinforcement is bound, and concrete is sprayed again to a thickness of 350 mm. To ensure stable preliminary supporting, at least one feet-lock bolt 14 is driven into a position of an anchor foot of the right pilot tunnel 12 of the arch.

In step 1 and step 2, when the pilot tunnels are excavated, blasting has a certain impact on adjacent pilot tunnels, and it is required that a footage of each pilot tunnel during construction should be greater than or equal to 15 m. When concrete is sprayed, operation should be carried out in strict accordance with requirements of a wet spraying process. The sprayed concrete should be dense and flat without cracking, peeling, missing spraying, reinforcement missing, hollowing, water leakage, and the like. The operation of spraying concrete should be orderly carried out from bottom to top in segments, in slices, and in layers.

Figure 3C:
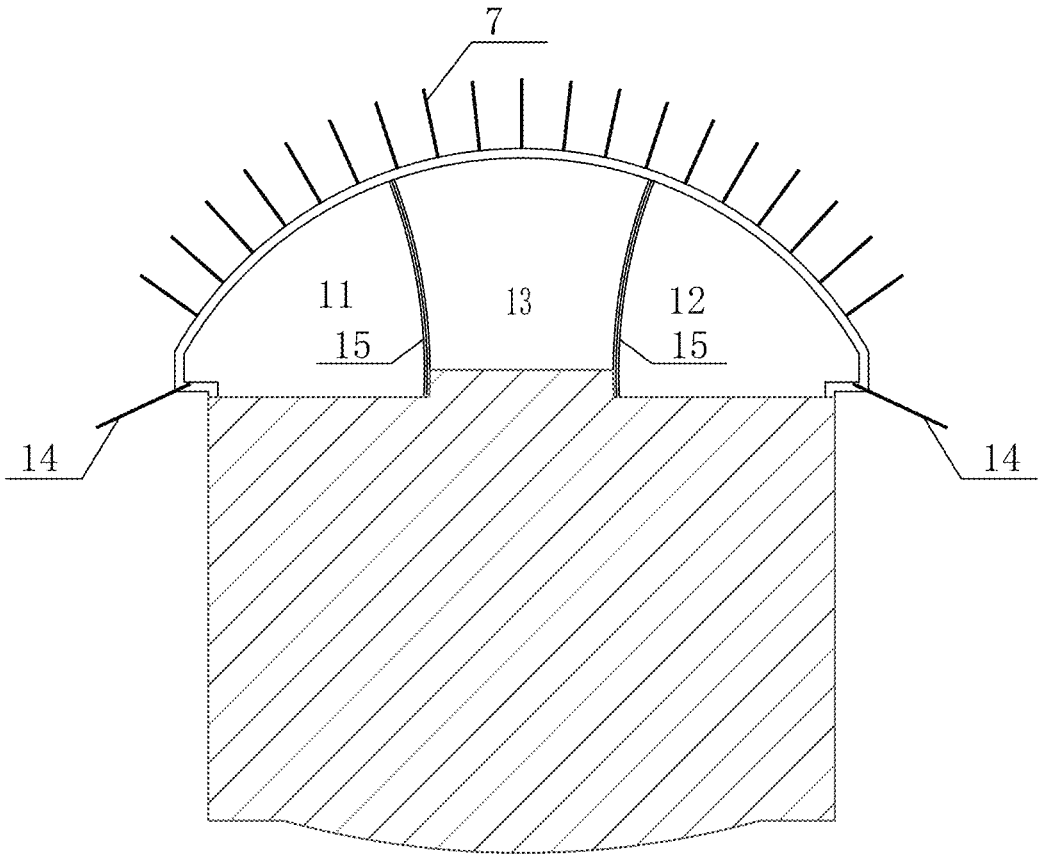

In step 3, with reference to FIG. 3C, remaining surrounding rock of a middle pilot tunnel 13 of the arch of the station is excavated. Note that not less than 1 m thick rock mass should be reserved. A temporary steel arch frame 15 for the middle pilot tunnel 13 of the arch is built in. Preferably, blasting should be controlled and the middle temporary steel arch support is protected.

Figure 3D:
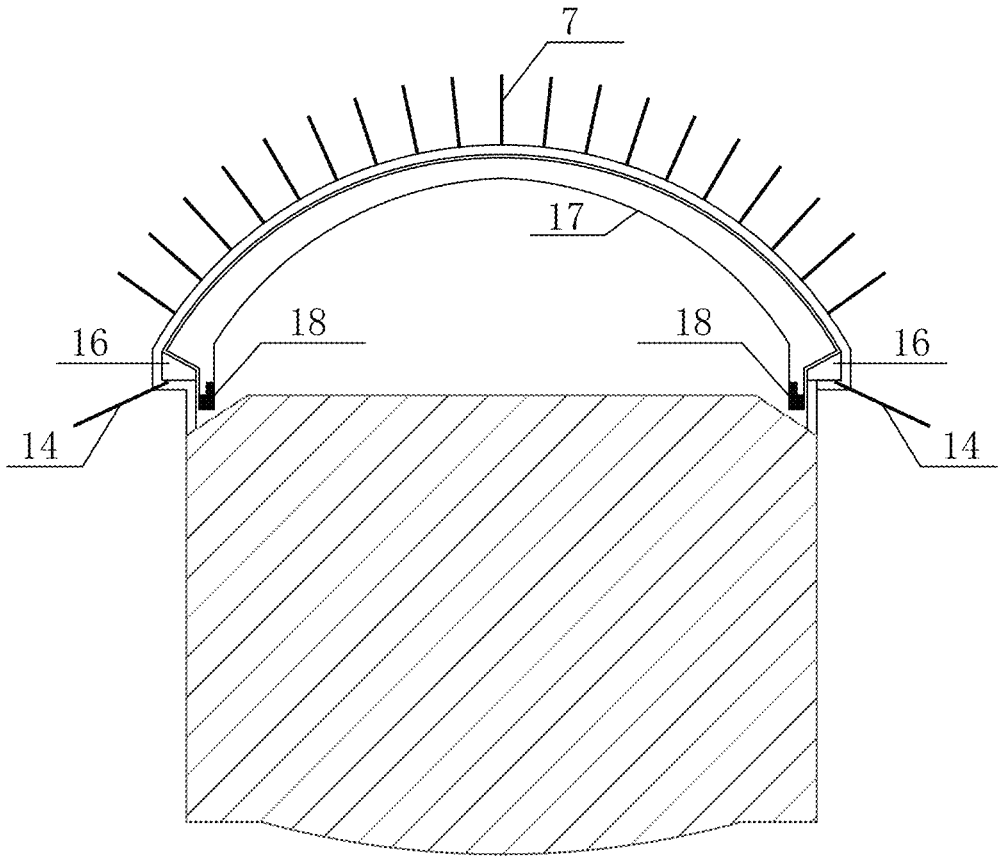

In step 4, with reference to FIG. 3D, a bottom bedding course is applied, and arch foot joists 16 on two sides are applied after the bottom bedding course reaches a strength. Preferably, inner ends of the feet-lock bolts 14 driven in the step 1 and step 2 are cast within the arch foot joists, thereby ensuring that the arch foot joists are stable and reliable.

In step 5: part of the temporary steel arch frame 15 is removed by means of a spatial effect (a length by which the support is removed each time is not more than 6 m); a waterproofing course is laid; and a second lining structure 17 of an arch covering is applied and a side wall construction seam is reserved. Meanwhile, monitoring and measurement are strengthened such that a length of a segment is adjusted timely.

Step 5 specifically includes the following technical contents.

1. The second lining structure 17 of the arch covering should be formed through one step and should not be cast in steps.
2. L-shaped joints 18 are disposed at joints of the side wall construction seam, respectively. The construction seam is treated using a filling method: when concrete is poured at bottom by a distance of 100 mm to 150 mm from the construction seam, laitance is removed, and shrinkage-free concrete of a same grade is used for filling.

Figure 3E:
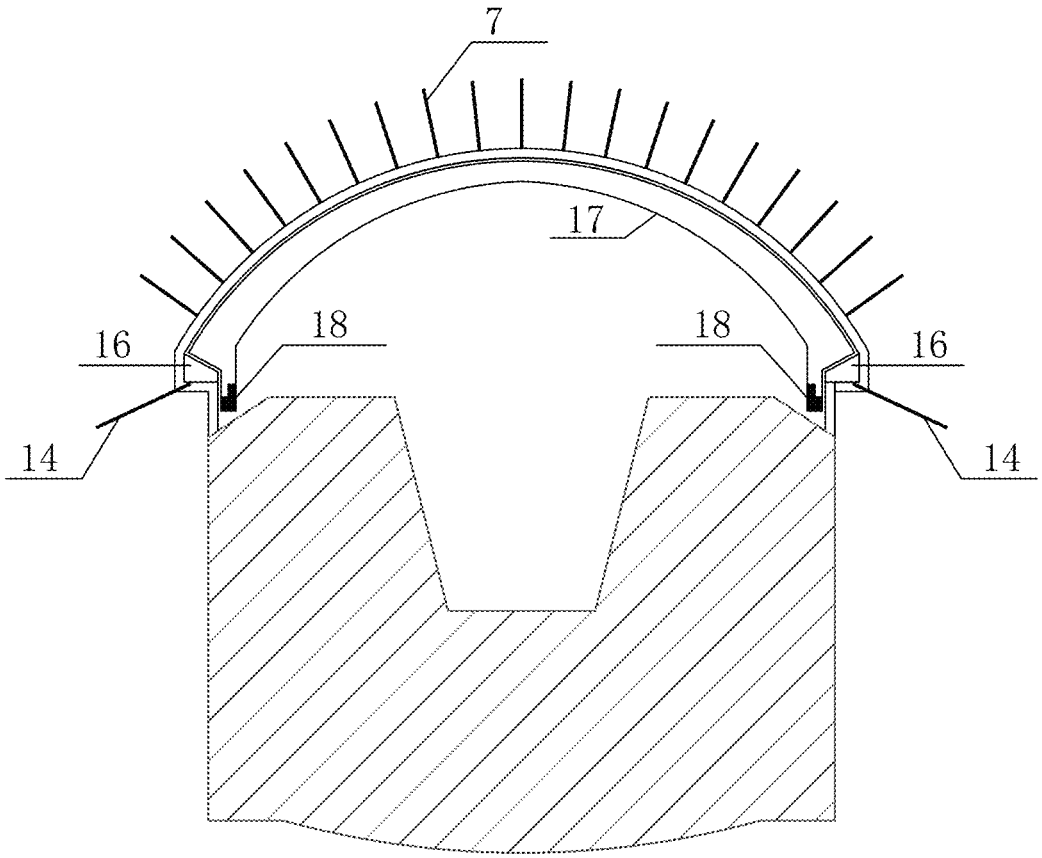

In step 6, with reference to FIG. 3E, after the second lining structure 17 of the arch covering reaches a design strength, step-slope excavation of middle-layer core soil is carried out. Preferably, a slope of the step-slope excavation should not be greater than 1:0.5, and a horizontal distance of tops of side slopes on two sides should not be less than 3 m.

Figure 3F:
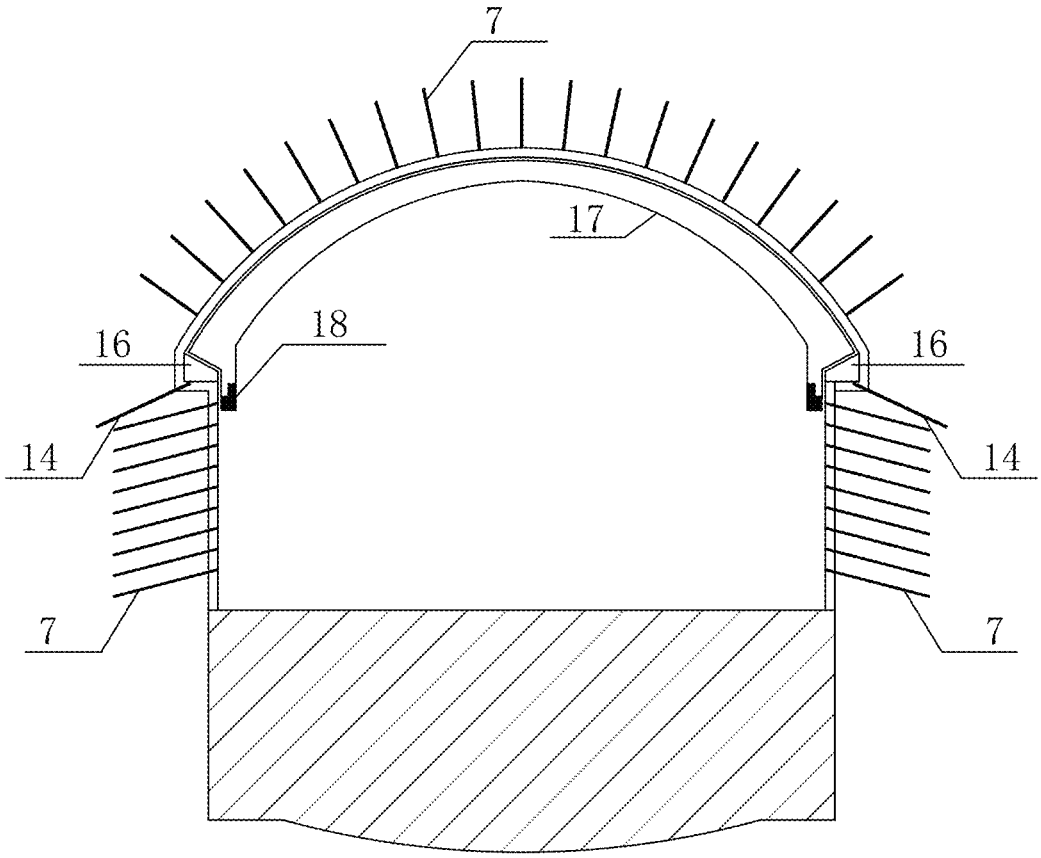

In step 7, with reference to FIG. 3F, surrounding rocks on two sides of the middle layer of the station are excavated layer by layer from top to bottom; excavation is carried out to current layer at each step and anchor bolts 7 are driven downwards by 0.5 m, and next step of excavation is carried out after the completion of applying the anchor bolts 7 on two sides and spraying concrete.

Figure 3G:
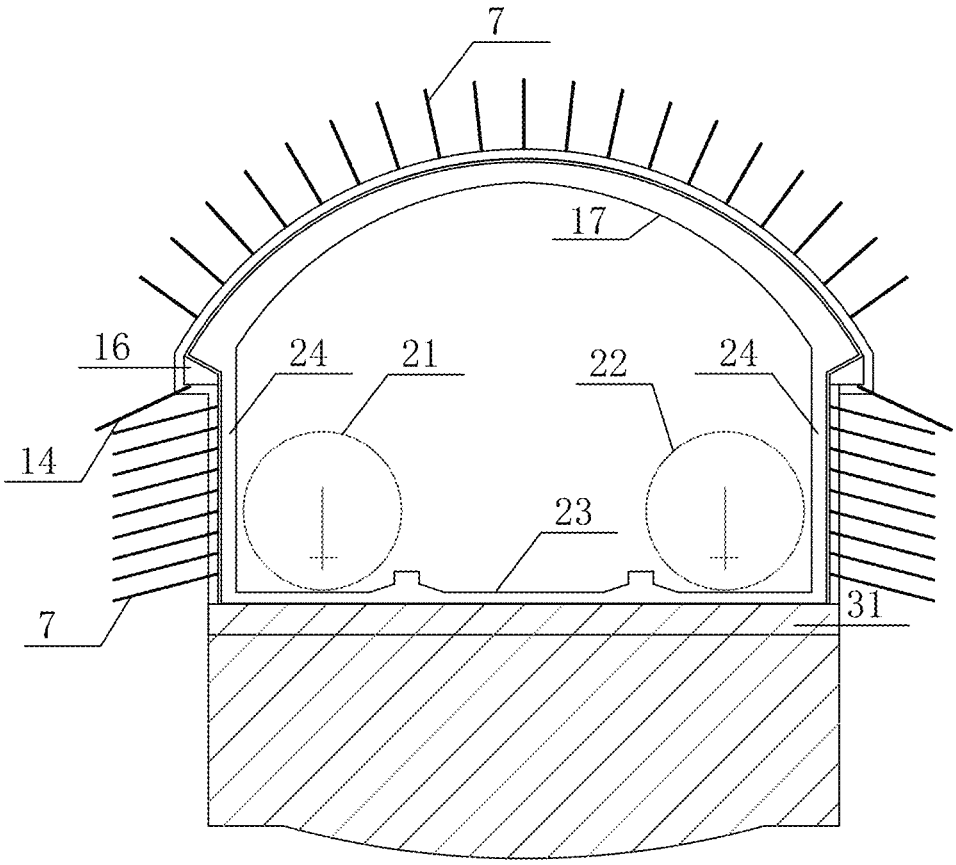

In step 8: with reference to FIG. 3G, after excavation to a design elevation, grouted tunnel wastes 31 are backfilled to a bottom elevation of a medium slab 23 of the second underground floor, and after a foundation bearing capacity required for pushing the shield tunneling machine is met, consequent operation of a medium slab structure 23 and second lining structures 24 for side walls of the first and second underground floors is carried out from bottom to top.

In particular, step 8 should specifically include the following technical contents.

1. The grouted tunnel wastes 31 backfilled should be uniformly roll-compacted, avoiding nonuniform bearing of stress by the structure. The backfilled tunnel wastes should be tamped in layers. A compactness of the roll-compacted tunnel wastes is greater than or equal to 93%, and during roll-compacting, each layer is 25 cm to 30 cm thick. Soil with good water permeability and poor soil quality, such as sandy soil and miscellaneous fill, should not be used.
2. Since the third underground floor is constructed using the reverse construction method, nodes should be reserved for the second lining structures 24 and permanent concrete columns 6 of the first and second underground floors. The second lining structures 24 and the permanent concrete columns 6 of the first and second underground floors are cast below the medium slab 23 of the second underground floor by not less than 500 mm; and a ratio of reserved joints of reinforcements at a same section is not greater than 50%. The reserved reinforcements are protected.

In step 9, after the second lining structure of the medium slab 23 of the second underground floor reaches a design strength, a subgrade is backfilled and a track is laid. At this time, the platform floor 2 of the subway line A communicates with the interzone tunnel 21 of the left line of the subway line A and the interzone tunnel 22 of the right line of the subway line A, and this meets the condition for pushing the shield tunneling machine through the station, and the shield tunneling machine for the construction of the subway line A may be pushed through the station.

Figure 3H:
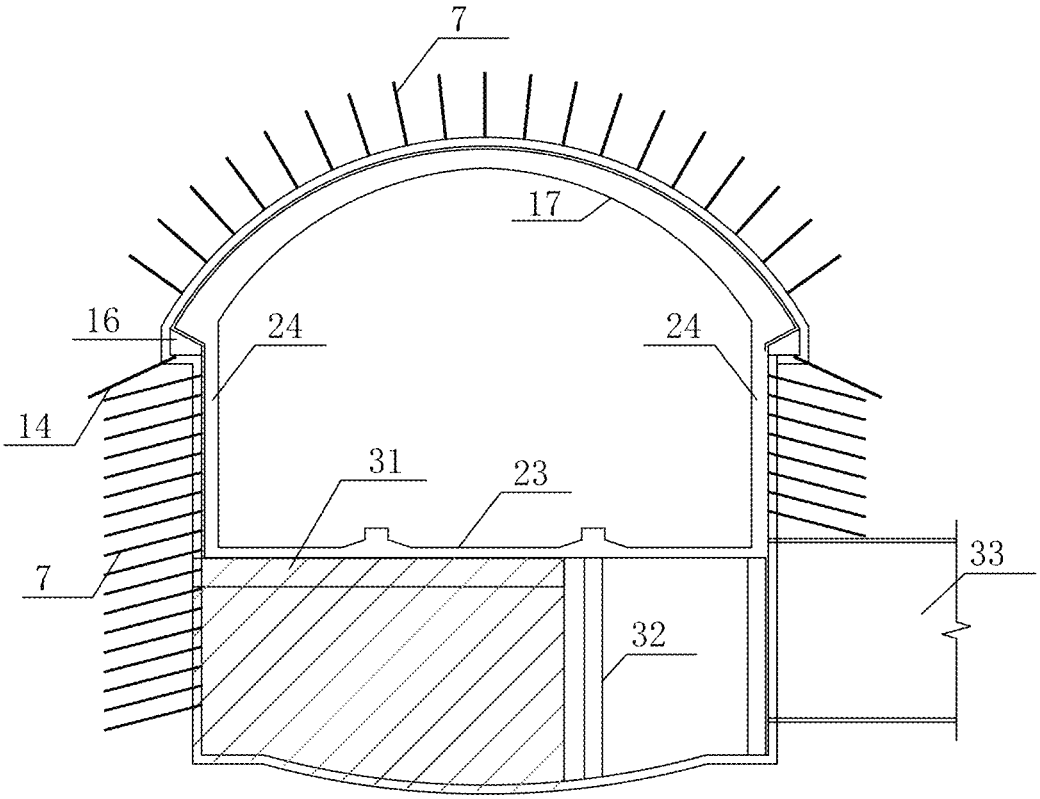
Figure 3I:
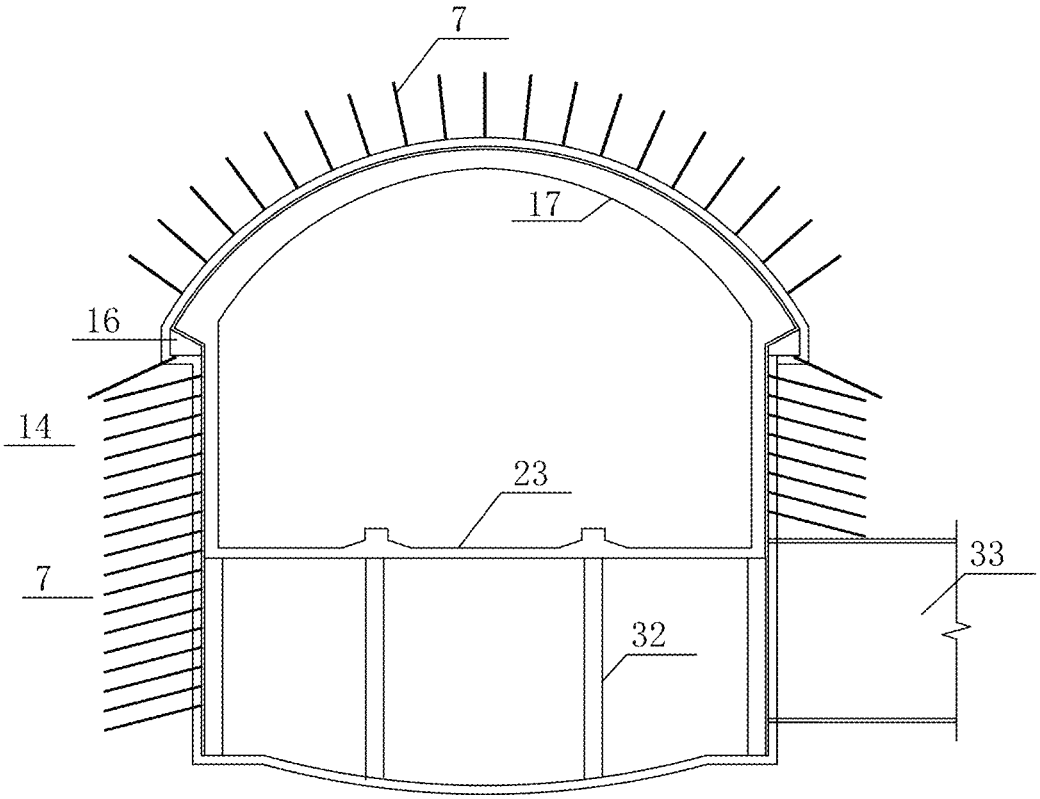

In step 10, with reference to FIG. 3H and FIG. 3I, an interzone tunnel of a left line of the subway line B 33 is used as a construction passageway; the platform floor 3 of the subway line B is cyclically excavated, and a temporary steel support 32 is applied timely. After the completion of each round of excavation, the support is removed gradually, and a second lining structure 35 of the third underground floor is applied timely. After the completion of applying the second lining structure 35 of the third underground floor, next round of excavation is carried out.

The following should be noted in the step 10.

1. The stability of the top grouted tunnel wastes 31 should be noted during excavation, avoiding collapse of the grouted tunnel wastes 31. A vibration insulation layer is formed after the completion of partitioned removal of the grouted tunnel wastes 31, and then blasting excavation is carried out.
2. For blasting, a blasting design should be made. Smooth blasting is recommended, and relevant parameters should be corrected timely according to a blasting effect. Blasting parameters should be determined after a trial blast on the spot according to the principles of shallow holes, dense distribution, weak blasting, and progressive blasting. In the blasting design, the influence of vibration on adjacent tunnels and buildings and structures in the proximity thereof is mainly considered to ensure construction safety.
3. Tunnel excavation should be carried out in strict accordance with the policies of short footage, weak blasting, strong support, and fast closure, reducing disturbance for the surrounding rock and reducing the influence of vibration on surrounding buildings. A vibration velocity of blasting for surrounding buildings should be controlled within 15 mm/s; otherwise, a machine should be used for carrying out excavation to guarantee the safety and stability of the surrounding buildings.

Specifically, step 10 includes the following sub-steps.

Figure 4A:
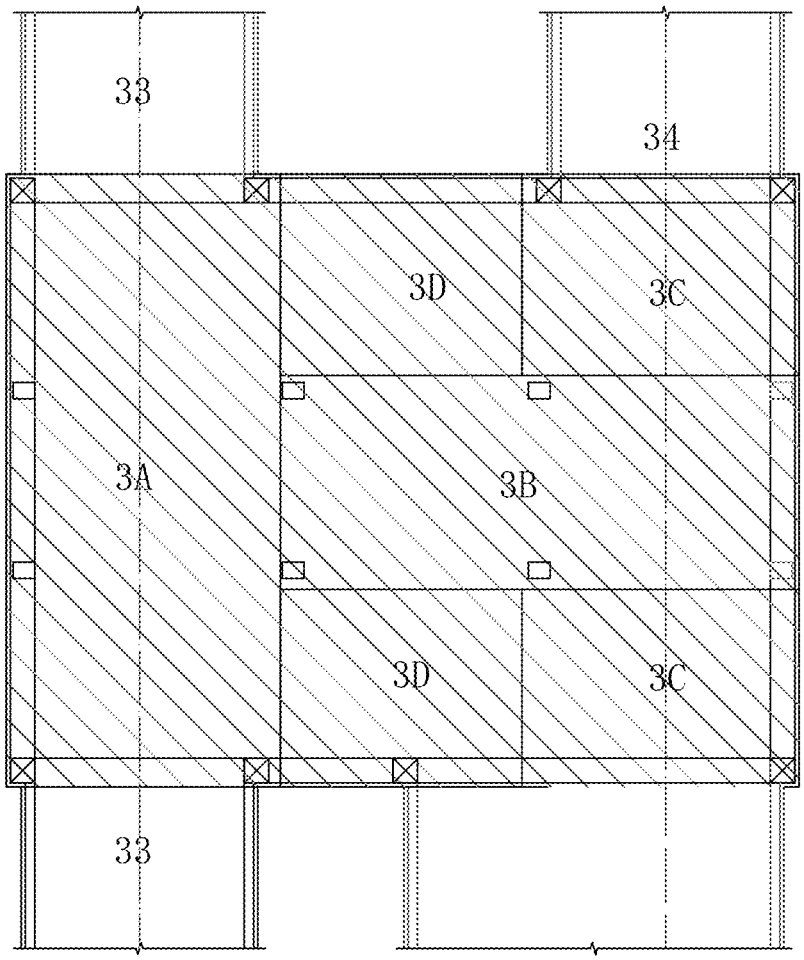
FIG. 4A to FIG. 4H show schematic diagram of a construction order of an undercutting-covered excavation semi-reverse construction method of a cross-transfer subway station at a plane of a third underground floor according to the present disclosure.

In step 10.1, with reference to FIG. 4A, the interzone tunnel 33 of the left line of the subway line B is used as the construction passageway, and the third underground floor of the station is excavated by a step method. Firstly, a track area 3A of the left line of the third underground floor is excavated. Before excavation, the grouted tunnel wastes 31 should be removed segmentally to form a vibration insulation layer, and then blasting excavation is carried out. Collapse of the grouted tunnel wastes is prevented and the existing structure is made safe. Excavation is carried out by a cyclical footage. The footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure should be taken. After the completion of excavation of the footage per round, bolting and shotcreting may be carried out in time and the temporary steel support 32 is erected to support the top slab of the third underground floor.

Figure 4B:
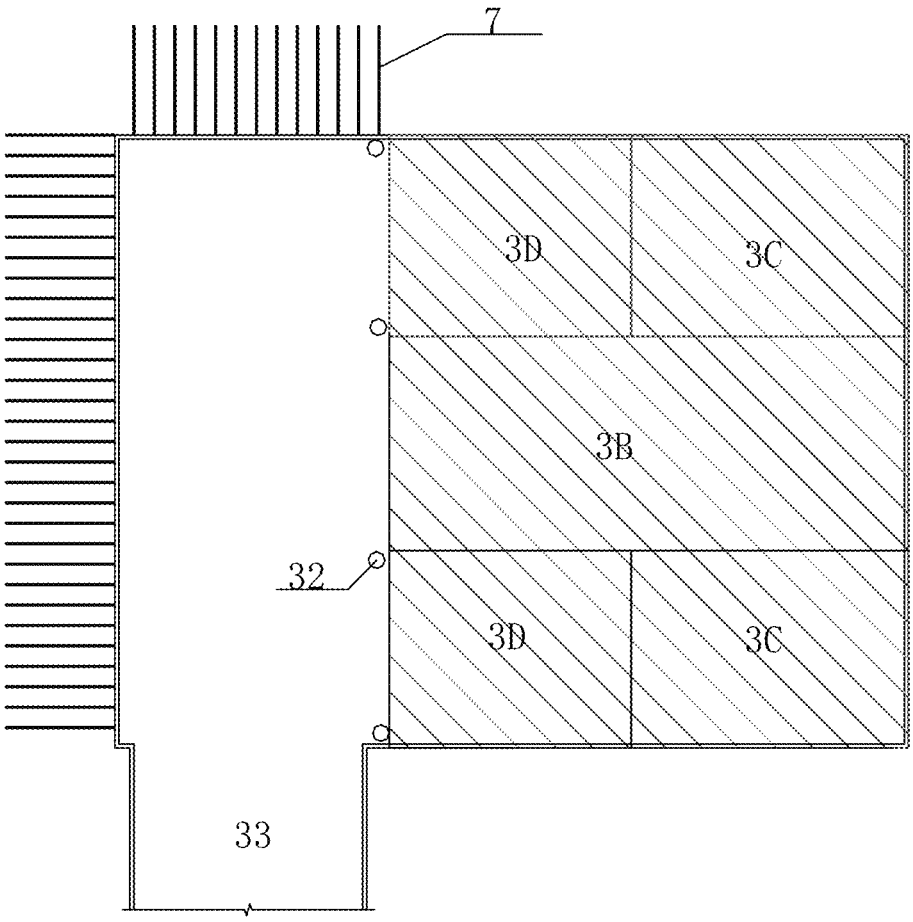

In step 10.2, with reference to FIG. 4B, after the excavation of the track area 3A of the left line of the third underground floor is completed, by entering into the tunnel from a middle position, the middle pilot tunnel 3B of the third underground floor is excavated also by the step method. Before excavation, the grouted tunnel wastes 31 should be removed segmentally to form a vibration insulation layer, and then blasting excavation is carried out. Collapse of the grouted tunnel wastes is prevented and the existing structure is made safe. Excavation is carried out by a cyclical footage. The footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure should be taken. After the completion of excavation of the footage per round, bolting and shotcreting may be carried out in time and the temporary steel support 32 is erected to support the top slab of the third underground floor. Meanwhile, the second lining structure 35 of the third underground floor for the track area 3A of the left line of the third underground floor is gradually applied.

Figure 4C:
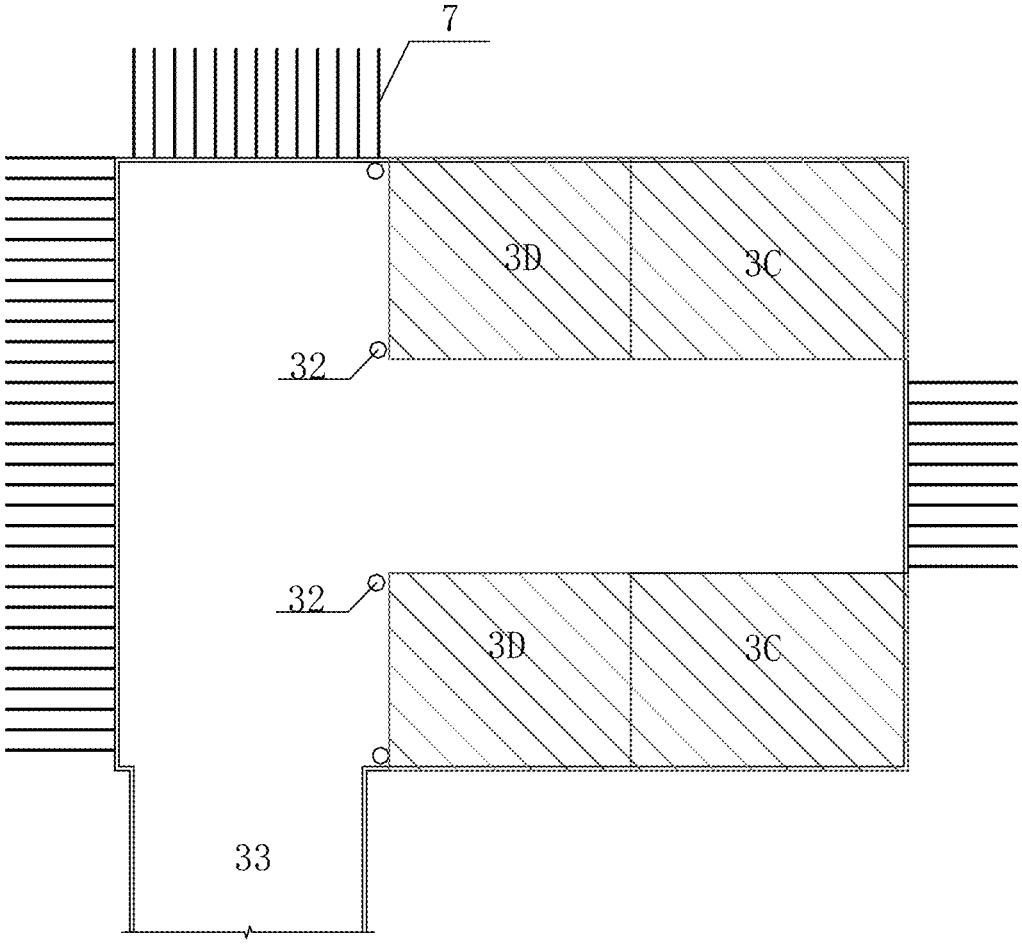
Figure 4D:
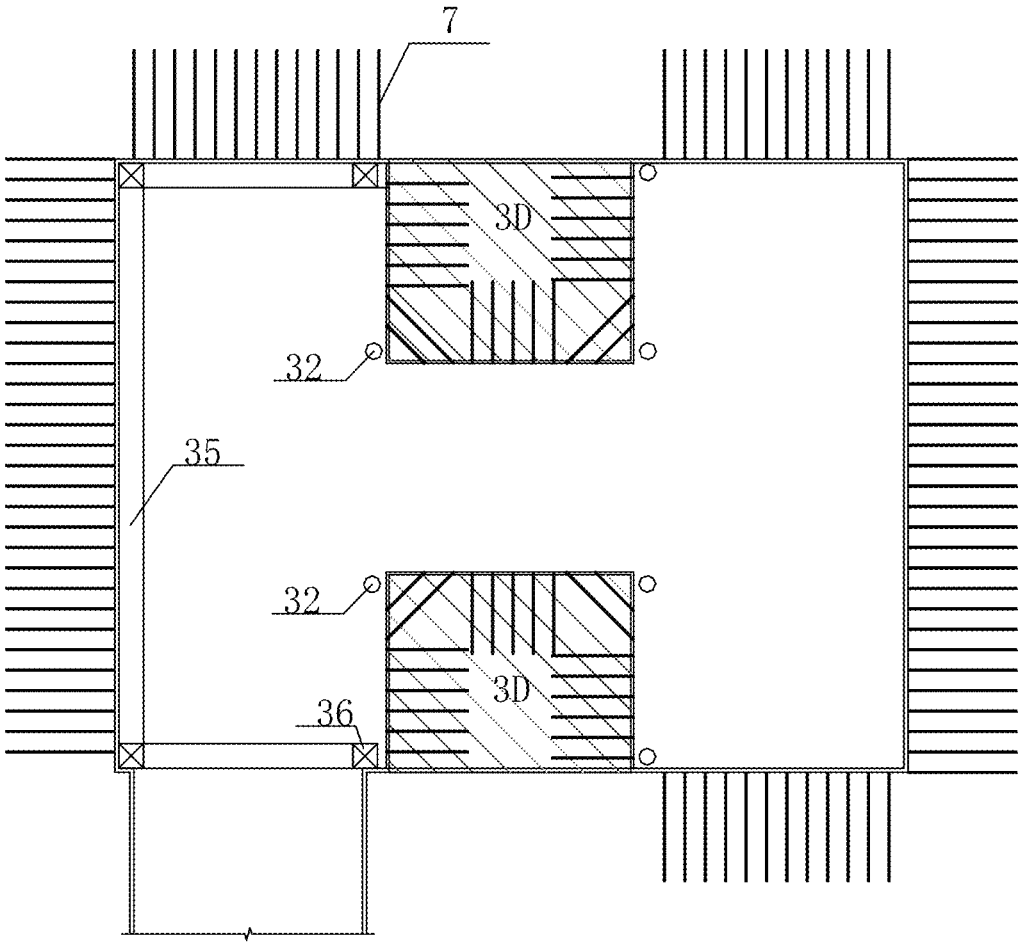

In step 10.3, with reference to FIG. 4C and FIG. 4D, after the excavation of the middle pilot tunnel 3B of the third underground floor is completed, tunnels are opened on two sides to excavate a track area 3C of a right line of the third underground line. Likewise, before excavation, the grouted tunnel wastes 31 should be removed segmentally to form a vibration insulation layer, and then blasting excavation is carried out. Collapse of the grouted tunnel wastes is prevented and the existing structure is made safe. Excavation is carried out by a cyclical footage. The footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure should be taken. After the completion of excavation of the footage per round, bolting and shotcreting may be carried out in time and the temporary steel support 32 is erected to support the top slab of the third underground floor. The second lining structure 35 of the third underground floor for the track area 3A of the left line of the third underground floor is completed, and the temporary support 32 of the track area 3A of the left line of the third underground floor is adjusted to be within the range of the second lining structure.

Figure 4E:
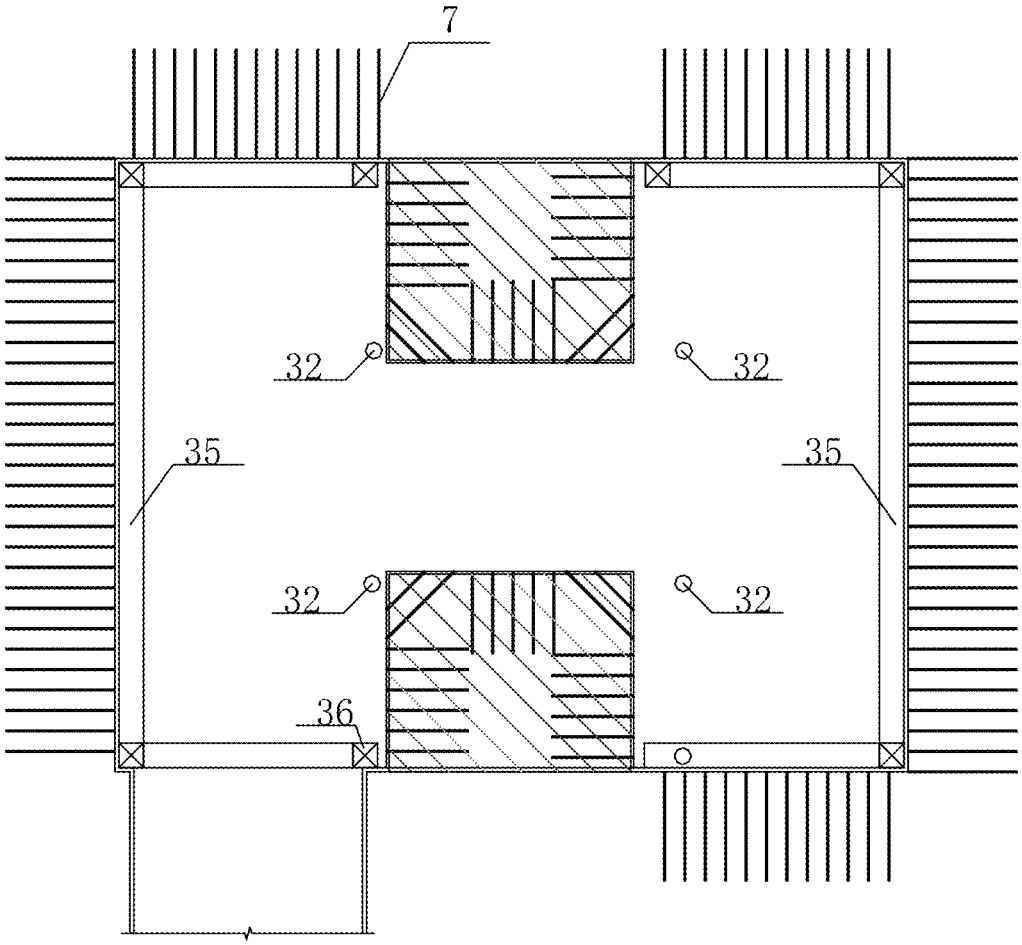

In step 10.4, with reference to FIG. 4E, the second lining structures of the middle pilot tunnel 3B and the track area 3C of the right line of the third underground floor are subsequently applied. After the completion of application and closure of the second lining structures 35 of the third underground floor on both flanks of H-shape, the temporary steel support 32 is adjusted to be within the range of the second lining structure.

Figure 4F:
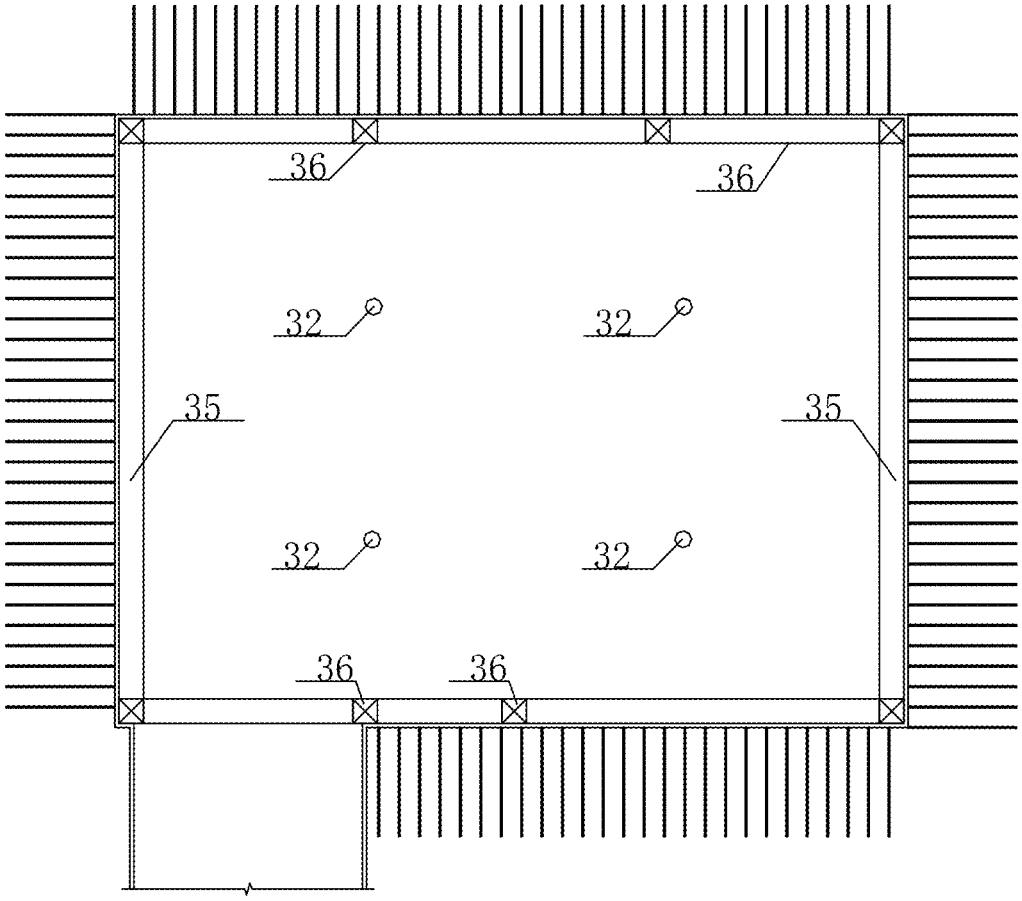

In step 10.5, with reference to FIG. 4F, after the completion of the second lining structures 35 of the third underground floor on two sides, the middle remaining rock mass 3D is excavated also by the step method. Before excavation, the grouted tunnel wastes 31 should be removed segmentally to form a vibration insulation layer, and then blasting excavation is carried out. Collapse of the grouted tunnel wastes is prevented and the existing structure is made safe. Excavation is carried out by a cyclical footage. The footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure should be taken. After the completion of excavation of the footage per round, bolting and shotcreting may be carried out in time and the temporary steel support 32 is erected to support the top slab of the third underground floor.

In step 10.6, the remaining second lining structure 35 of the third underground floor is completed, and the temporary steel support 32 is provided.

Figure 4G:
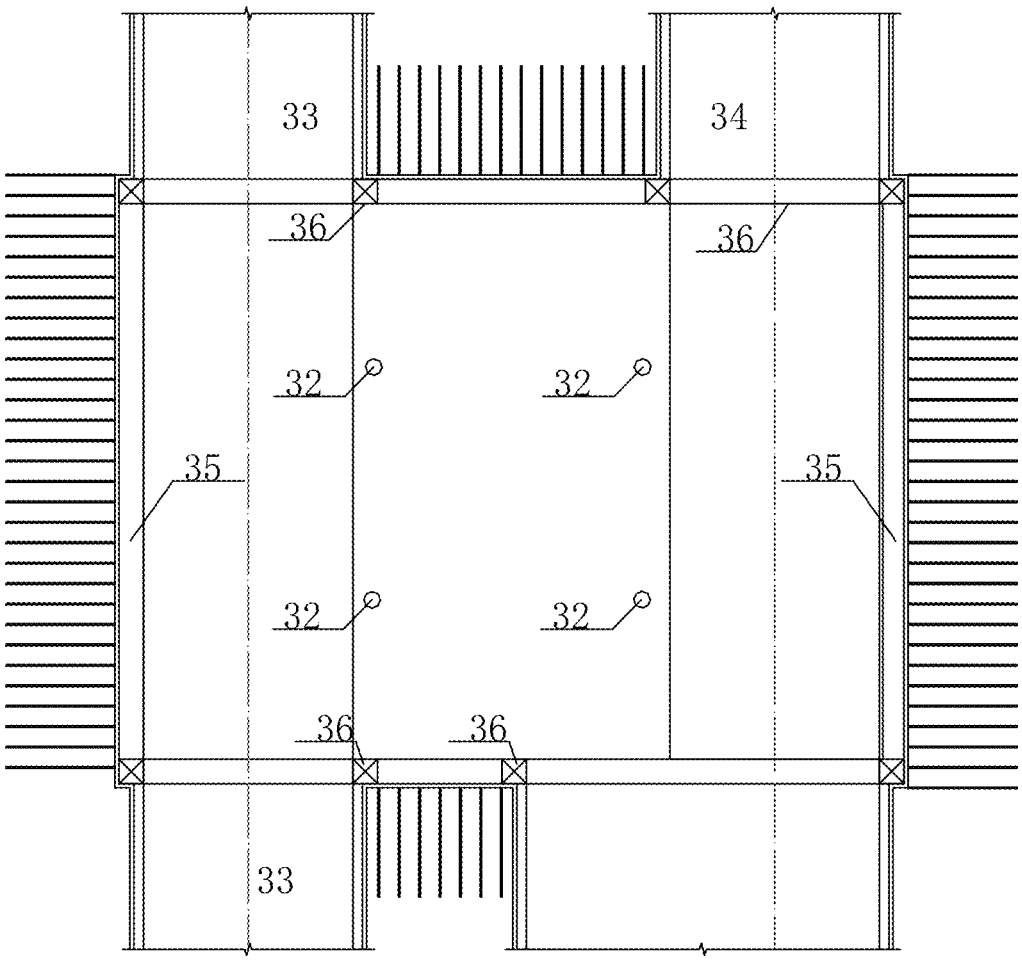

In step 10.7, with reference to FIG. 4G, an interzone tunnel 34 of the right line of the subway line B is excavated, and three grid steel frames are erected. A shaft inset is opened to enter the tunnel. C25 concrete is sprayed immediately after excavation to close the surrounding rock; the grid arch frame is erected; the temporary steel support is erected; a mesh reinforcement is bound; and concrete is sprayed. To guarantee the safety of the second lining structure of the station, a vibration attenuation measure should be taken before excavation. The blasting vibration velocity is strictly controlled within 15 mm/s. When necessary, mechanical excavation is adopted.

Figure 4H:
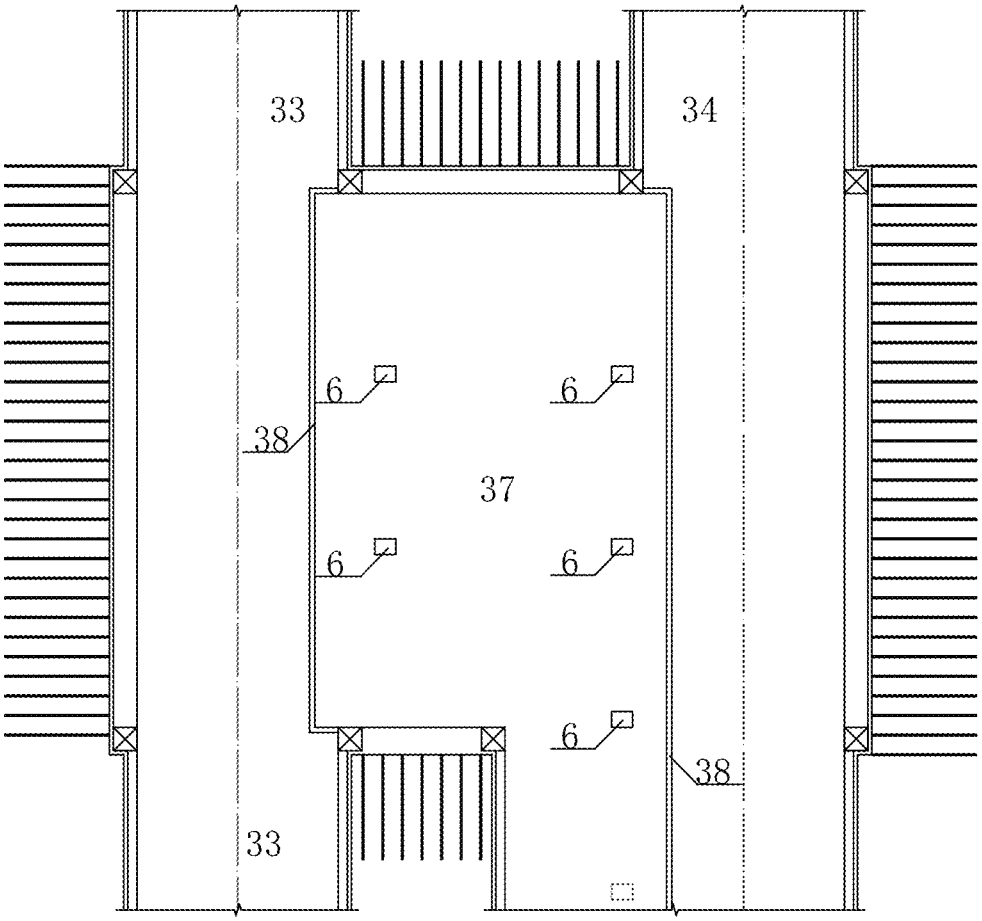

In step 11, with reference to FIG. 4H, after the completion of the second lining structure 35 of the third underground floor, remaining interzone ports of the subway line B may be excavated. After a shield tunneling machine for the construction of the subway line B is pushed through the station, the temporary steel support 32 is gradually removed, permanent concrete columns 6 are applied, and internal structures such as a track area partition wall 38 and a platform transfer passageway 37 are applied.

As can be seen, the present disclosure involves the following key steps and the following advantages:

1. The undercutting-covered excavation semi-reverse construction method is used. The section of the transfer node provided in the present disclosure is in the form of three underground floors. The first underground floor and the second underground floor are undercut by the arch covering method. After the backfilled grouted tunnel wastes have a sufficient foundation bearing capacity and the second lining structure of the medium slab of the second underground floor reaches the design strength, the shield tunneling machine for the two lines may be pushed through the station. After the shield tunneling machine is pushed through the station, the structure of the third underground floor is constructed by the reverse construction method. Thus, the construction efficiency can be improved to the utmost extent and the construction period can be saved, guaranteeing that the construction of the interzone node is preferably completed as early as possible.
2. After excavation to the design elevation, the grouted tunnel wastes are backfilled to the bottom elevation of the medium slab. The grouted tunnel wastes backfilled should be uniformly roll-compacted, avoiding nonuniform bearing of stress by the structure. The backfilled tunnel wastes should be tamped in layers. A compactness of the roll-compacted tunnel wastes is greater than or equal to 93%, and during roll-compacting, each layer is 25 cm to 30 cm thick. Soil with good water permeability and poor soil quality, such as sandy soil and miscellaneous fill, should not be used. Thus, the foundation bearing capacity below the medium slab of the second underground floor may be effectively improved and the requirement of flatness is met. Nonuniform stress on the medium slab structure of the second underground floor or structural damage caused by insufficient bearing capacity below when the shield tunneling machine is pushed through the station are prevented.

Apparently, the foregoing descriptions and contents are merely exemplary and not intended to limit the disclosures, application, or use of the present disclosure. Although the embodiments have been described above and in the accompanying drawings, the present disclosure does not limit particular examples that are illustrated in the accompanying drawings and described in the embodiments as the teaching of the currently considered best mode to carry out the present disclosure. The scope of the present disclosure will include any embodiment falling within the foregoing description and the appended claims.

What is claimed is:

1. An undercutting-covered excavation semi-reverse construction method of a cross-transfer subway station, wherein a section of a node of the cross-transfer subway station covers three underground floors, wherein a first underground floor is a station hall floor, and a second underground floor is a platform floor of a subway line A and a third underground floor is a platform floor of a subway line B; directions of the subway line A and the subway line B are orthogonal; construction is carried out by an arch covering method at the station hall floor and the platform floor of the subway line A; and after a shield tunneling machine for interzone construction of the subway line A is pushed through the station, construction of the platform floor of the subway line B is carried out by covered excavation using a reverse construction method under the section constructed by the arch covering method; the undercutting-covered excavation semi-reverse construction method comprises the following steps:

step 1: stepwise excavating a left pilot tunnel of an arch; after the completion of excavation, initially spraying 40 mm thick concrete to close surrounding rock, applying anchor bolts, arranging a grid arch frame, erecting a temporary steel arch frame for the left pilot tunnel of the arch, and spraying concrete again to a thickness of 350 mm;

step 2: stepwise excavating a right pilot tunnel of the arch; after the completion of excavation, initially spraying 40 mm thick concrete immediately to close surrounding rock, applying anchor bolts, arranging a grid arch frame, erecting a temporary steel arch frame, and spraying concrete again to a thickness of 350 mm;

step 3: excavating remaining surrounding rock of a middle pilot tunnel of the arch of the station and building in a temporary steel arch frame for the middle pilot tunnel of the arch;

step 4: applying a bottom bedding course, and applying arch foot joists on two sides after the bottom bedding course reaches a strength;

step 5: removing part of the temporary steel arch frame by means of a spatial effect, laying a waterproofing course, and applying a second lining structure of an arch covering and reserving a side wall construction seam;

step 6: after the second lining structure of the arch covering reaches a design strength, carrying out step-slope excavation of middle-layer core soil;

step 7: excavating surrounding rocks on two sides of the middle layer of the station layer by layer from top to bottom; excavating to current layer at each step and driving anchor bolts downwards by 0.5 m, and carrying out next step of excavation after the completion of applying the anchor bolts on two sides and spraying concrete;

step 8: after excavation to a design elevation, backfilling grouted tunnel wastes to a bottom elevation of a medium slab of the second underground floor, and after a foundation bearing capacity required for pushing the shield tunneling machine is met, carrying out consequent operation of a medium slab structure and second lining structures for side walls of the first and second underground floors from bottom to top;

step 9: after the second lining structure of the medium slab of the second underground floor reaches a design strength, backfilling a subgrade, laying a track, and pushing the shield tunneling machine for the construction of the subway line A through the station;

step 10: using an interzone tunnel of a left line of the subway line B as a construction passageway, cyclically excavating the platform floor of the subway line B, and timely applying a temporary steel support; after the completion of each round of excavation, gradually removing the support, timely applying a second lining structure of the third underground floor, and after the completion of applying the second lining structure of the third underground floor, carrying out next round of excavation; and step 11: after the completion of the second lining structure of the third underground floor, excavating remaining interzone ports of the subway line B, and applying an internal structure after a shield tunneling machine for the construction of the subway line B is pushed through the station.

2. The undercutting-covered excavation semi-reverse construction method of the cross-transfer subway station according to claim 1, wherein in the step 1, at least one feet-lock bolt is driven into a position of an anchor foot of the left pilot tunnel of the arch; and in the step 2, at least one feet-lock bolt is driven into a position of an anchor foot of the right pilot tunnel of the arch.

3. The undercutting-covered excavation semi-reverse construction method of the cross-transfer subway station according to claim 1, wherein in the step 1 and step 2, a footage of each pilot tunnel is greater than or equal to 15 m when the pilot tunnel is excavated.

4. The undercutting-covered excavation semi-reverse construction method of the cross-transfer subway station according to claim 2, wherein in the step 4, inner ends of the feet-lock bolts driven in the step 1 and step 2 are cast within the arch foot joists, thereby ensuring that the arch foot joists are stable and reliable.

5. The undercutting-covered excavation semi-reverse construction method of the cross-transfer subway station according to claim 1, wherein the second lining structure of the arch covering in the step 5 is formed through one step, and L-shaped joints are disposed at joints of the side wall construction seam, respectively.

6. The undercutting-covered excavation semi-reverse construction method of the cross-transfer subway station according to claim 1, wherein a slope of the step-slope excavation in the step 6 is not greater than 1:0.5, and a horizontal distance of tops of side slopes on two sides is not less than 3 m.

7. The undercutting-covered excavation semi-reverse construction method of the cross-transfer subway station according to claim 1, wherein the grouted tunnel wastes backfilled in the step 8 are uniformly roll-compacted with a compactness of greater than or equal to 93%; during roll-compacting, each layer is 25 cm to 30 cm thick; the second lining structures and permanent concrete columns of the first and second underground floors are cast below the medium slab of the second underground floor by not less than 500 mm; a ratio of reserved joints of reinforcements at a same section is not greater than 50%.

8. The undercutting-covered excavation semi-reverse construction method of the cross-transfer subway station according to claim 1, wherein the step 10 comprises the following sub-steps:

step 10.1: using the interzone tunnel of the left line of the subway line B as the construction passageway, firstly excavating a track area of the left line of the third underground floor using a step method, carrying out excavation by a cyclical footage, and after the completion of excavation of the footage per round, carrying out bolting and shotcreting in time and erecting the temporary steel support to support a top slab of the third underground floor;

step 10.2: entering into the tunnel from a middle position, and excavating the middle pilot tunnel of the third underground floor; carrying out excavation by cyclic footages also by the step method, and after the completion of excavation of the footage per round, carrying out bolting and shotcreting in time and erecting the temporary steel support to support the top slab of the third underground floor; meanwhile, gradually applying the second lining structure of the third underground floor for the track area of the left line of the third underground floor;

step 10.3: opening tunnels on two sides to excavate a track area of a right line of the third underground line; carrying out excavation by a cyclical footage, and after the completion of excavation of the footage per round, carrying out bolting and shotcreting in time and erecting the temporary steel support to support the top slab of the third underground floor; completing the second lining structure of the third underground floor for the track area of the left line of the third underground floor, and adjusting the temporary support of the track area of the left line of the third underground floor to be within the range of the second lining structure;

step 10.4: subsequently applying the second lining structures of the middle pilot tunnel and the track area of the right line of the third underground floor, and after the completion of application and closure of the second lining structure of the third underground floor, adjusting the temporary steel support to be within the range of the second lining structure;

step 10.5: excavating remaining rock mass in the middle, carrying out excavation by a cyclical footage also by the step method, and after the completion of excavation of the footage per round, carrying out bolting and shotcreting in time and erecting the temporary steel support to support the top slab of the third underground floor;

step 10.6: completing the remaining second lining structure of the third underground floor, and providing the temporary steel support; and step 10.7: excavating an interzone tunnel of the right line of the subway line B, erecting three grid steel frames, spraying C25 concrete immediately after excavation to close the surrounding rock, erecting the grid arch frame, erecting the temporary steel support, binding a mesh reinforcement, and spraying concrete.

9. The undercutting-covered excavation semi-reverse construction method of the cross-transfer subway station according to claim 8, wherein in steps 10.1, 10.2, 10.3, and 10.5, the cyclical footage is 0.5 m to 1.2 m in a soil layer and unstable rock mass, and is 1 m to 1.5 m in stable rock mass; and when a stable time of an excavation face of the unstable rock mass does not meet preliminary supporting construction, an advanced supporting or grouting reinforcement measure is taken.

* * * * *